United States Patent [19]

Williams et al.

[11] Patent Number: 4,566,498

[45] Date of Patent: Jan. 28, 1986

[54] REED CONTROL MECHANISM FOR TERRY LOOM

[76] Inventors: Gilmer A. Williams, Rte. 5, Box 57, Kannapolis, N.C. 28081; Douglas Burgess, Rte. 1, Box 278, Woodleaf, N.C. 27054

[21] Appl. No.: 652,418

[22] Filed: Sep. 19, 1984

Related U.S. Application Data

[63] Continuation of Ser. No. 460,441, Jan. 24, 1983, abandoned.

[51] Int. Cl.[4] ..... D03D 39/22

[52] U.S. Cl. ..... 139/26

[58] Field of Search ..... 139/25, 26, 27, 188, 139/190

[56] References Cited

U.S. PATENT DOCUMENTS 4,294,290 10/1981 Freisler ..... 139/26

FOREIGN PATENT DOCUMENTS 42443 2/1888 Austria ..... 139/26

*Primary Examiner*—Henry S. Jaudon

*Attorney, Agent, or Firm*—Cohen, Pontani & Lieberman

[57] ABSTRACT

A reed control mechanism for a terry type loom is disclosed. The reed control mechanism enables the reed to perform a three pick cycle comprising partial beat up of the first two picks of weft followed by full beat up of the third pick of weft. Reciprocating motion is applied to a lay beam on which the reed is mounted by a crank arm whose motion is driven by a rotatable driving element. The rotatable driving element is coupled to the crank arm through a mechanical linkage which includes a pneumatic or hydraulic cylinder. The pneumatic or hydraulic cylinder serves to shift the arc of the reed so as to effect partial beat up of certain picks of weft and full beat up of other picks of weft.

8 Claims, 4 Drawing Figures

REED CONTROL MECHANISM FOR TERRY LOOM

This is a continuation of application Ser. No. 460,441, filed Jan. 24, 1983, now abandoned.

TECHNICAL FIELD

This invention relates to looms for weaving terry-type fabric and more particularly to improved means for reed control during each terry cycle.

BACKGROUND ART

Typically, terry weave is formed in three pick cycles, that is, with two partial beat ups and one full one. However, cycles involving four or more picks are often used, there always being at least one full beat up to the cycle. Three-pick-cycle terry is woven by placing individually two picks of weft into open sheds of ground and terry warp ends, and by means of the reed, moving those two picks of weft to a position parallel with, but separate from, the fell of the woven fabric. A third pick of weft is then inserted into a shed and all three are beat up to the fell of the fabric together by being slid between the tautly held ground warp ends. The terry warp ends are slackened prior to the moment of beat up and will be carried along with the three picks thereby forming loops on the top and bottom surfaces of the fabric. The distance or length of terry warp which separates the fell of the fabric and the position of placement of the first two picks of weft is a determining factor in the height of the resulting terry loops. It is desirable that this separating distance be easily andd accurately changed when necessary and positively retained while weaving any particular fabric construction. The positioning of the two or more picks of weft at a distance from the fell of the fabric will be termed in this disclosure a "partial beat up" as contrasted to the "full beat up" which takes place after insertion of the third and final pick of each three pick terry cycle.

In a loom for weaving terry-type fabric, a reed control mechanism must be used to vary the stroke of the reed to effect partial beat up of certain picks of weft and full beat up of other picks of weft. While numerous reed control mechanisms for terry-type looms are known in the art such as those disclosed in A. J. Herard et al, U.S. Pat. No. 2,082,888 issued June 8, 1937; G. Berg, U.S. Pat. No. 2,599,313 issued June 3, 1952; E. C. Nichols et al, U.S. Pat. No. 3,265,095 issued Aug. 9, 1966; Gotz et al, U.S. Pat. No. 3,339,589 issued Sept. 5, 1967; E. C. Nichols, U.S. Pat. No. 3,363,653 issued Jan. 16, 1968; J. D. Harkey, U.S. Pat. No. 3,434,504 issued Mar. 25, 1969; S. C. Tiernan, U.S. Pat. No. 3,467,146 issued Sept. 16, 1969; Volpe, U.S. Pat. No. 3,788,359 issued Jan. 29, 1974; Seifert, U.S. Pat. No. 3,889,719 issued June 17, 1975 and Robert, U.S. Pat. No. 3,939,876 issued Feb. 4, 1976, none of these references disclose a mechanically simple and economical reed control mechanism for reproducibly varying the stroke of the reed in a terry-type loom so as to effect partial beat up of certain picks and full beat up of other picks. In fact, in many conventional terry looms, relatively complex gearing or cam controlled linkage members are used to vary the stroke of the reed to implement the three-pick-terry cycle. One relatively simple reed control mechanism which is disclosed in Kuster et al, U.S. Pat. No. 3,822,726 issued July 9, 1974, utilizes a plurality of pneumatic or hydraulic cylinders to impart reciprocating motion to the reed in a loom. However, the Kuster reference does not provide a way for reproducibly varying the stroke of the reed so as to implement a terry-type weaving cycle comprising partial beat up of certain picks of weft and full beat-up of other picks of weft.

Accordingly, it is an object of the present invention to provide an economical and mechanically simple reed control mechanism which enables implementation of a terry-type weaving cycle comprising partial beat up of certain picks and full beat up of other picks. In addition, it is a further object of the present invention to provide a means for easily and accurately controlling the distance separating the partially beat up picks and the fell of the already woven fabric so as to control the pile height of the fabric.

SUMMARY OF THE INVENTION

The present invention is a reed control mechanism to be used in connection with a loom for weaving terry-type fabric. In a preferred embodiment of the invention, the reed control mechanism comprises a reciprocating movement imparting means such as a crank arm located near the center of the lay beam upon which the reed is mounted for imparting reciprocating movement to the lay beam. Generally, the crank arm reciprocates about a crank shaft which extends parallel to the lay beam. The motion of the crank arm is driven by a driving element such as a cam or crank which rotates about a shaft that also extends parallel to the lay beam. The rotating driving element is coupled to the crank arm through a mechanical linkage which includes first and second spaced apart longitudinal members and a control element for varying the distance separating the longitudinal members and, thus, the length of the mechanical linkage so as to effect partial beat up of certain picks of weft and full beat up of other picks of weft. Changing the length of the mechanical linkage serves to shift the arc of the reed leftward or rightward depending on whether full or partial beat up of a given pick of weft is desired. Thus, when it is desired to position a pick of weft adjacent the fell of the already woven fabric (full beat up) the length of the mechanical linkage is changed so that the arc of the reed is shifted toward the fell of the fabric. On the other hand, when it is desired to position a pick of weft spaced apart from the fell of the fabric (partial beat up) the length of the mechanical linkage is changed so that the arc is shifted away from the fell of the fabric.

Typically, the control element for varying the length of the mechanical linkage comprises a pressure operated element such as a standard pneumatic or hydraulic piston-cylinder. It should be noted, however, that other elements such as an electromagnetically operated element may be used instead of a pressure controlled element. In the case of a pneumatic or hydraulic piston-cylinder, one of the longitudinal elements comprising the mechanical linkage is fastened to the piston-rod of the cylinder and the other longitudinal element is fastened to the base of the cylinder. When a pressure medium such as compressed air or oil enters the cylinder near the base the piston-rod is forced outward to lengthen the mechanical linkage. Similarly, when the pressure medium enters the cylinder near the end from which the piston-rod protrudes, the piston rod is forced inward to shorten the mechanical linkage. Standard timer circuits serve to regulate the flow of pressure medium to the cylinder to effect full beat up of the weft during the third pick of each three pick terry cycle and to effect partial beat up of the weft during the first two picks of each three pick terry cycle. Thus, in contrast with the above-mentioned Kuster reference wherein pneumatic cylinders are used to impart reciprocating motion to the lay beam and reed, in the present invention the pneumatic cylinder or other control element serves to adjust at regular intervals the stroke of the reed whose motion is imparted in another manner.

As previously indicated, the height of the pile of three-pick-cycle terry fabric is determined by the distance between the fell of the already woven fabric and the position of placement of the first two picks after partial beat up has taken place. In order to effectively adjust this distance, it is generally necessary to adjust the stroke of the reed during the partial beat-up of the first two picks. This may be done through the use of an adjustment element such as an adjustable nut or other stop means which may be included in the mechanical linkage for regulating the spacing between the longitudinal members comprising the mechanical linkage during partial beat up of the first two picks.

Use of the above described reed control mechanism in the weaving of terry type fabrics results in several advantages. The reed control mechanism is mechanically simple, economical to build, and leads to precise control of the partial and full beat up steps through the use of a control element such as pneumatic or hydraulic cylinder to shift the stroke of the reed. In addition, the use of an adjustable nut in the mechanical linkage enables a given reed control mechanism to be used in the manufacture of terry type fabrics having different pile heights. Such advantages have not been heretofore disclosed in prior art reed control mechanisms for terry-type looms.

BRIEF DESCRIPTION OF THE DRAWING

In the drawing figures, which have not been drawn to scale and wherein similar reference characters denote similar elements throughout the several views.

BEST MODE FOR CARRYING OUT THE INVENTION

Figure 1:
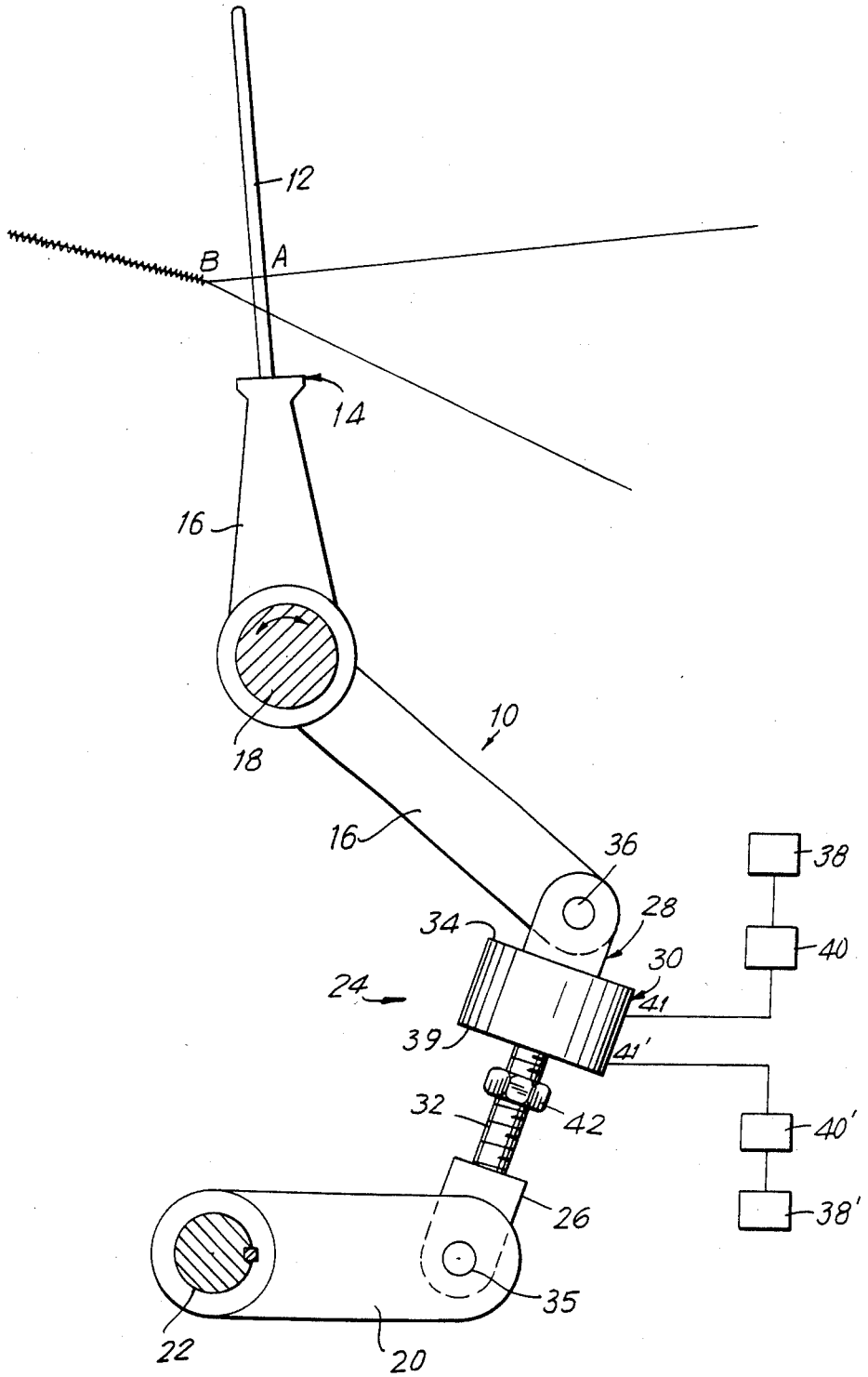
FIG. 1 shows an illustrative embodiment of the inventive reed control mechanism and the resulting position of the reed when the mechanical linkage is relatively short and the reed is shifted rearward by the control mechanism but in the forward position by the crank arm.
Figure 2:
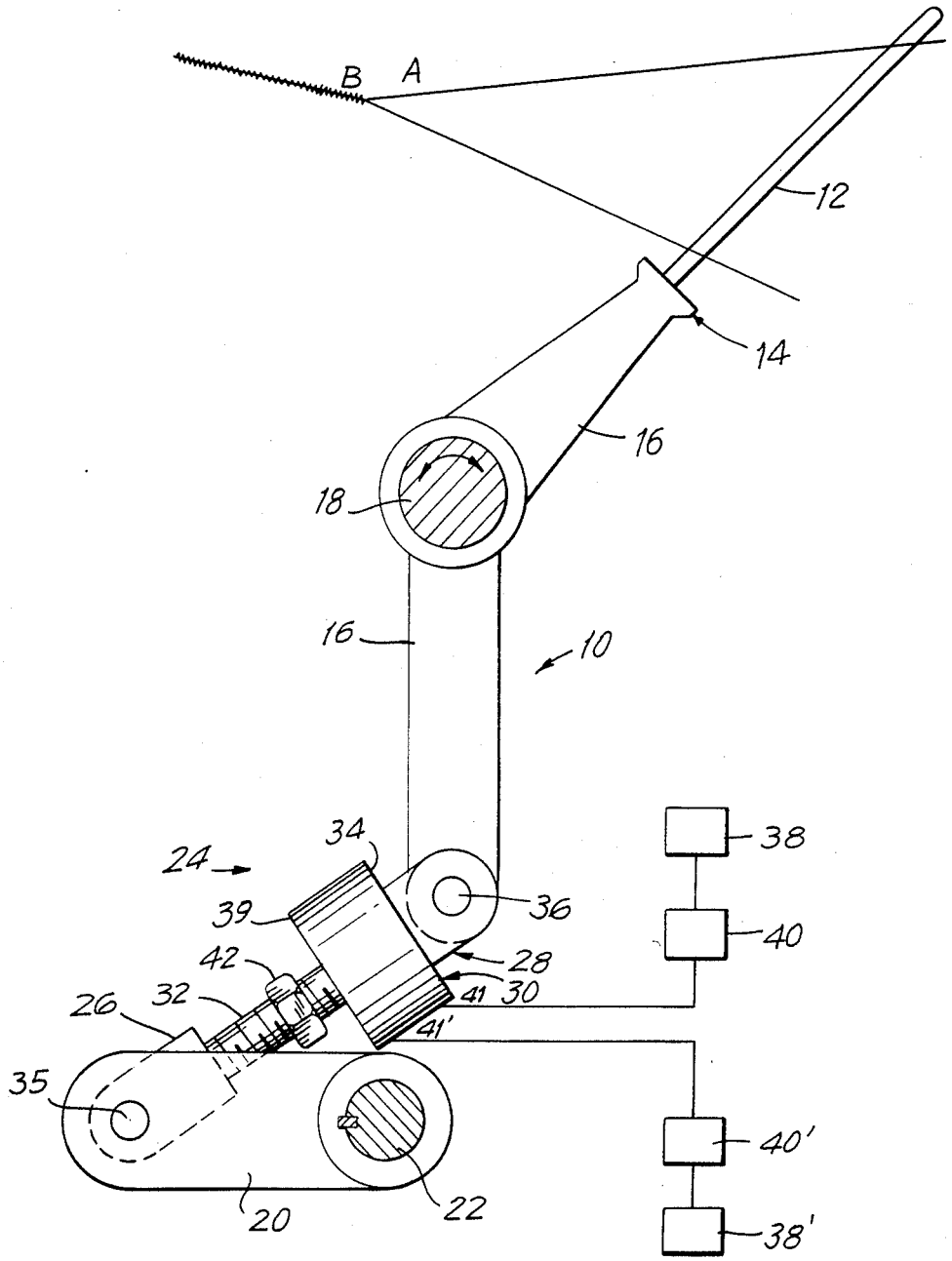
FIG. 2 shows the reed control mechanism of FIG. 1 when the mechanical linkage is relatively short and the reed is shifted rearward by the control mechanism and in the extreme rearward position by the crank arm.

Now referring to the FIGS. 1 and 2, there is illustrated a reed control mechanism generally indicated by numeral 10. The reed control mechanism 10 serves to control the reciprocating motion of the reed 12 which is mounted on a lay beam 14. Although not indicated in the figures, the reed 12 and the lay beam 14 extend substantially across the width of the loom. Reciprocating motion is imparted to the reed 12 and the lay beam 14 by a reciprocating motion imparting means here shown as a crank arm 16 which reciprocates about a lay shaft 18. Generally, crank arm 16 is located near the center of the lay beam 14 and the reed 12. The reciprocating movement of the crank arm 16 is driven by a driving element or crank 20 which as shown preferably rotates in the clockwise sense about a shaft crank 22 that is mounted on the loom and extends parallel to lay beam 14 and lay shaft 18. The crank 20 is connected to crank arm 16 through a mechanical linkage 24 which includes a pair of spaced apart longitudinal links 26 and 28 and an interposed adjustable member here shown to be a pneumatic piston-cylinder 30 for controlling the spacing between the longitudinal links 26, 28 and thus the length of the mechanical linkage 24. Of course, the adjustable member may be a hydraulic piston-cylinder instead of pneumatic piston-cylinder 30 or any other such member, such as, for example, an electromagnetically controlled piston-cylinder. Longitudinal element 26 which is fastened to the piston-rod 32 of the cylinder 30 is pivotally connected to the crank 20 by axle 35. Similarly, longitudinal element 28, which is fastened to the base end 34 of the cylinder 30, is pivotally connected to the crank arm 16 by axle 36. A pressure medium, here shown as compressed air is connected to the cylinder 30 near the base 34. In the Figures, this connection is shown in a schematic manner only, the actual structure being well within the skill of the ordinary worker. The flow of the compressed air from diagrammatically illustrated standard pressure vessel 38 is controlled by diagrammatically illustrated standard timing circuit 40. When the pressure medium stored in vessel 38 enters the cylinder 30, near the base 34 through diagrammatically illustrated inlet 41, the piston-rod 32 is forced outward from the cylinder thereby extending the effective length of mechanical linkage 24. A pressure medium, here shown as compressed air is also connected to the cylinder 30 near end 39. The flow of compressed air from diagrammatically illustrated standard pressure vessel 38' into the cylinder 30 through diagrammatically illustrated inlet 41' is regulated by diagrammatically illustrated standard timing circuit 40'. When compressed air enters the cylinder 30 near end 39, the piston rod 32 is forced inward, thereby shortening the effective length of the mechanical linkage 24.

As previously indicated, the reed control mechanism 10 is intended to enable the reed to perform a three pick terry cycle which involves partial beat up of the first two picks of weft followed by full beat up of the third pick of weft. The workings of the inventive reed control mechanism 10 can be understood by considering its operation during a single three pick cycle which corresponds to three rotations of the crank 20, one for each pick. Operation of the reed control mechanism 10 during the first two picks is shown in FIG. 1, and operation of the reed control mechanism 10 during the third pick is shown in FIG. 2.

Starting from an arbitrary initial position of the reed 12 and associated reed control mechanism 10 which is shown in phantom in FIG. 1, as the driver element 20 rotates in the clockwise direction about the shaft crank 22, the reed 12 is driven leftward in an arc. The leftward most position of the reed 12 is indicated by position A in FIG. 1. At this time, the orientation of the associated reed control mechanism 10 is shown in FIG. 1. As the reed moves leftward through the arc, it carries with it a pick of weft (not shown). As the crank 20 continues in its clockwise rotation returning reed 12 and associated reed control mechanism 10 to the initial position shown in FIG. 2, the reed 12 moves rightward through its arc leaving the pick of weft behind at position A. Note that position A is separated from the fell of the fabric whose location is schematically illustrated by position B. Thus, there has occurred partial beat up of the first pick of weft. Upon a second rotation of the crank 20, another pick of weft is positioned near position A.

Figure 3:
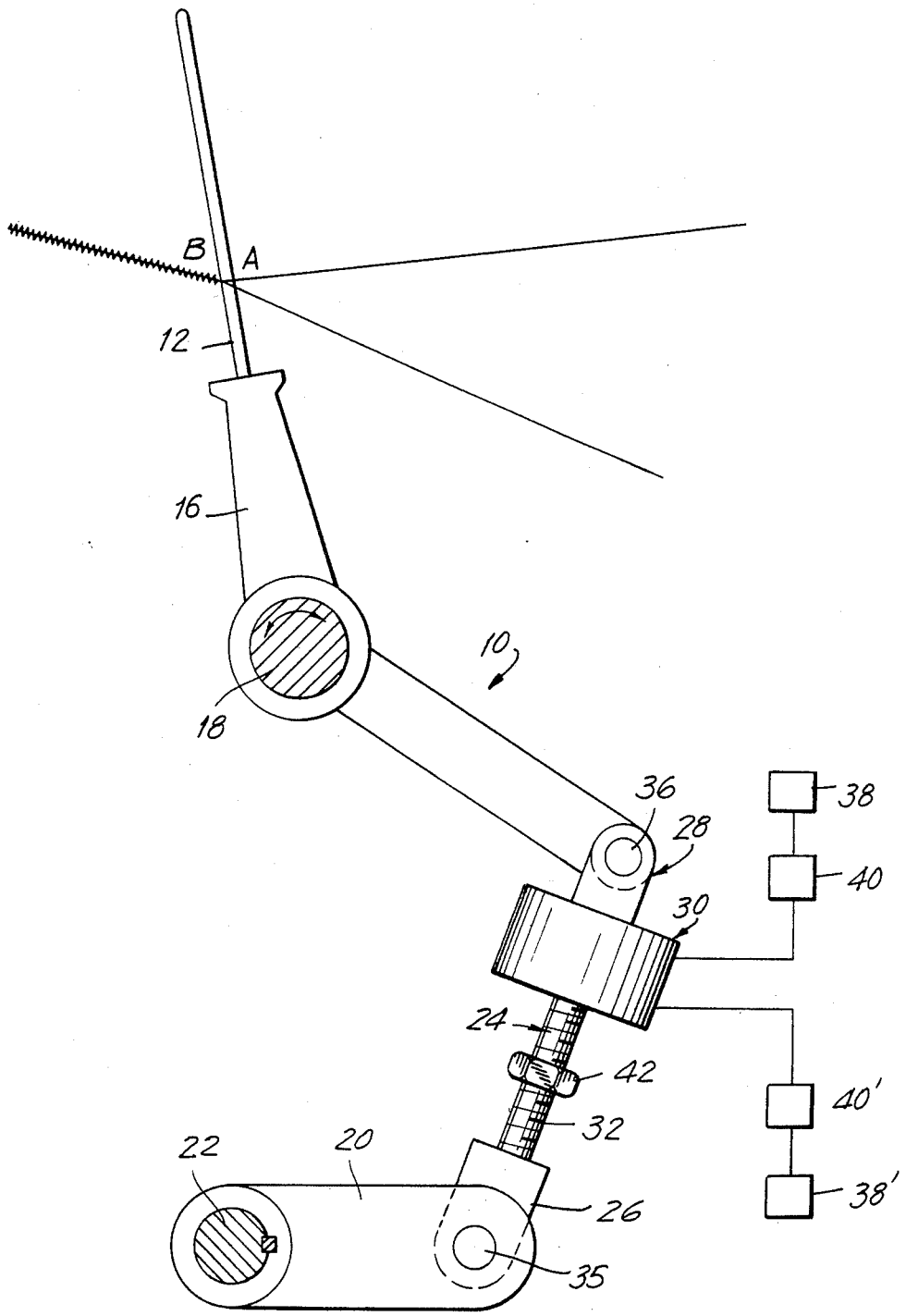
FIG. 3 shows the reed control mechanism of FIG. 1 and the resulting position of the reed when the mechanical linkage is relatively long and the reed is in the extreme forward position.
Figure 4:
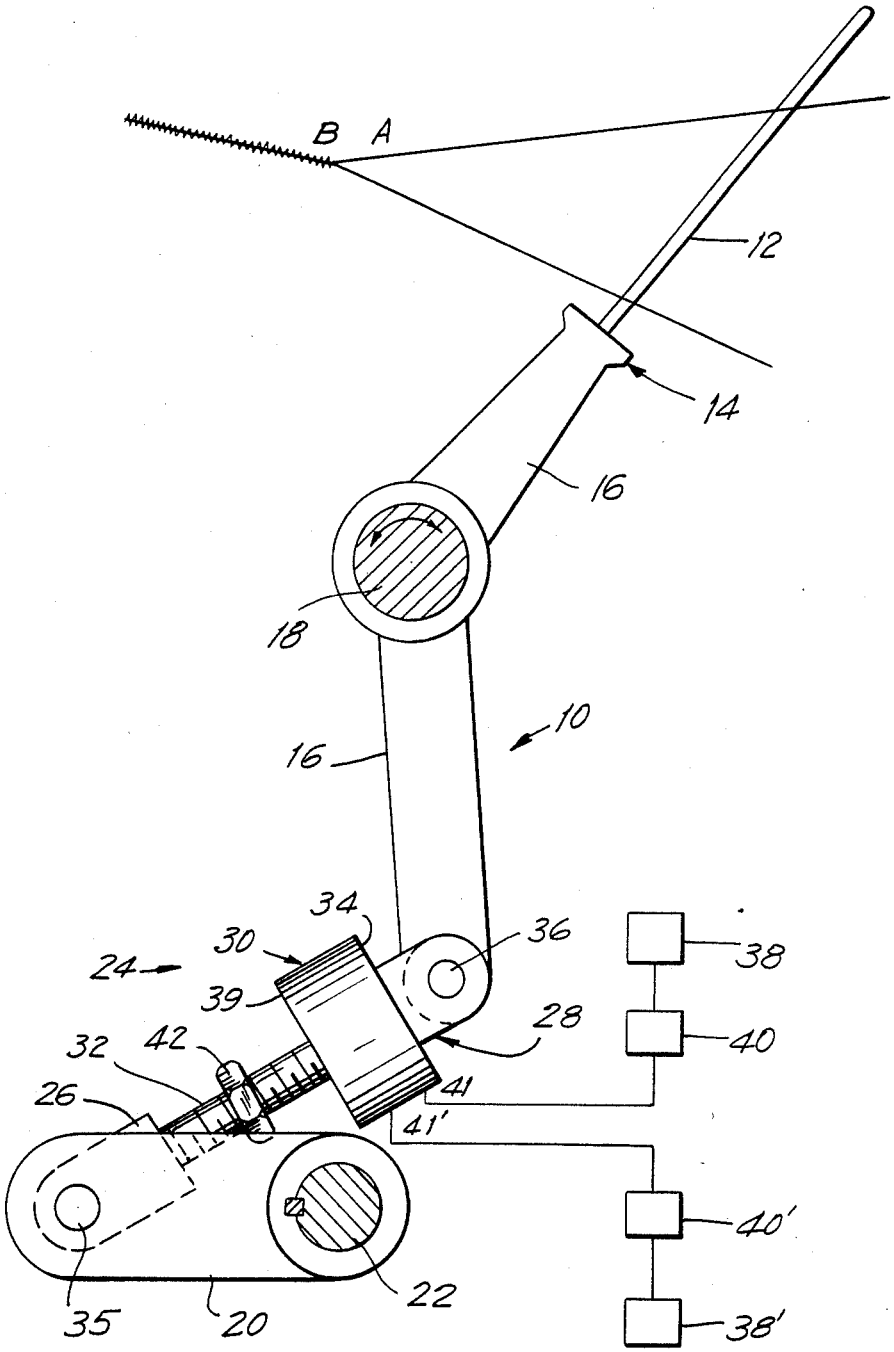
FIG. 4 shows the reed control mechanism of FIG. 1 and the resulting position of the reed when the mechanical linkage is relatively long and the reed is in the rearward position.

Illustratively, as shown in FIG. 2, at the start of the third rotation of the crank 20, the piston rod 32 of the cylinder 30 starts to extend outward, thus lengthening the mechanical linkage 24 and causing the arc of the reed 12 to shift leftward in an arc. The leftwardmost position of the reed 12 is indicated by FIG. 1. As the reed 12 moves leftward through its arc the third pick of weft as well as the first two picks of weft which were previously positioned at A are positioned at position B. Position B is the leftward most position of the reed 12 as it moves through its arc and generally corresponds to the fell of the fabric. When the reed 12 reaches position B, the corresponding orientation of the reed control mechanism 10 is shown by the drawing of FIG. 3. When this position is reached, the piston rod 32 of the cylinder 30 is maximally extended. Hence, as will be recognized by those of ordinary skill, the height of the terry pile is determined by the difference in position of points A and B. Note that, during the second half of the third rotation of the crank 20, the piston rod of the pneumatic cylinder 30 is forced inward so that the mechanical linkage is shortened and partial beat up of the first pick of the next cycle is effected.

Mechanical linkage 24 also includes continuously adjustable nut 42 for adjusting the relative positions of points A and B to thereby adjust the pile height of the resulting terry fabric. The nut 42 is incorporated as part of the piston-rod 32 and serves as a means for regulating the length of the mechanical linkage 24 during partial beat up steps. Adjustment of the nut 42 results in a leftward or rightward shift of the arc of the reed but does not appreciably change the length of the arc of the reed. When it is desired that there be a relatively short pile height, the nut 42 should be positioned adjacent end 39 of the cylinder 30 during the partial beat up steps. When the nut 42 is so positioned, the movement of the piston rod 32 into the cylinder 30 is limited by the nut. Thus mechanical linkage 24 is relatively long and the corresponding arc of the reed 12 is shifted to the left, thereby giving rise to a relatively small distance between the partially beat up first two picks of the three pick terry cycle (point A) and the fell of the fabric (point B). On the other hand where a relatively large pile height is desired, the nut may be spaced apart from the end 39 of the cylinder 30 during the partial beat up steps in which case movement of the piston-rod 32 into the cylinder is limited only by the geometry of the cylinder. This serves to shift the arc of the reed 12 to the right and results in a relatively long distance between the partially beat up first two picks of the three pick terry cycle (Point A) and the fell of the fabric (Point B).

Finally, it is to be understood that the above described embodiment of the invention is intended to be illustrative only. Numerous alternative embodiments of the invention may be derived by those skilled in the art without departing from the spirit and scope of the invention as set forth in the following claims. In particular, although operation of the inventive reed control mechanism has been described in connection with three pick cycle terry, the inventive reed control mechanism may also be used in connection with terry cycles involving four or more picks of weft. Illustratively, a four pick terry cycle involves partial beat up of three picks of weft followed by full beat up of a fourth pick of weft. In addition, in the case of a relatively wide loom, instead of one crank arm and associated driving element and mechanical linkage located near the center of the lay beam, two crank arms, one located on each side of the loom may be used. In this case, each crank arm reciprocates with a common crank shaft and is driven by a rotatable driving element. A mechanical linkage which illustratively includes a pneumatic or hydraulic cylinder couples each driving element to the associated crank arm.

What is claimed is:

1. In a loom for weaving pile-type fabric, an improved reed control mechanism for enabling a reed mounted on a lay beam to perform a multi-pick cycle involving partial beat-up of at least a first pick of weft and full beat up of at least a second pick of weft, said reed control mechanism comprising:

means for imparting reciprocating movement to said lay beam and said reed;

a driving means coupled to said loom; and a mechanical linkage connecting said driving means to said reciprocating movement imparting means for enabling said driving means to drive said reciprocating movement imparting means, the improvement being characterized in that said mechanical linkage comprises first and second spaced apart elements and a pressure operated control element for maintaining a first spacing between said elements during said first pick of weft and a second spacing between said elements during said second pick of weft, thereby adjusting the terminal point of said reed during reciprocation to enable said partial beat up of at least said first pick and said full beat up of at least said second pick, wherein said pressure operated element is a pneumatic piston-cylinder whose piston-rod is fastened to one of said elements and whose base is fastened to the other of said elements.

2. The reed control mechanism of claim 1, wherein said piston-rod includes an adjustable element for making an adjustment in the length of the mechanical linkage during said partial beat up of said first pick and thus an adjustment in the pile height of said pile-type fabric.

3. In a loom for weaving terry type fabric, a reed control mechanism for enabling the reed to perform a three pick cycle comprising partial beat up of the first two picks followed in succession by a full beat up of the third pick, said reed control mechanism comprising:

a lay beam on which said reed is mounted;

means for imparting reciprocating motion to said lay beam and said reed;

driving means coupled to said loom;

a mechanical linkage connecting said driving means to said reciprocating motion imparting means to enable said reciprocating motion imparting means to reciprocate said lay beam, said mechanical linkage comprising first and second spaced apart longitudinal elements and a hydraulic cylinder located between said spaced apart longitudinal elements; and means for controlling the pressurization of said cylinder so that there is a first spacing between said longitudinal elements during said third pick of each of said three pick cycles and a second spacing between said longitudinal elements during the first two picks of each of said three pick cycles thereby adjusting the terminal point of said reed during reciprocation so as to enable full beat up of said third pick and partial beat-up of said first two picks.

4. A method for enabling a reed in a terry loom to operate on a three pick cycle, said cycle comprising partial beat up of the first two picks and full beat up of the third pick to form a terry type fabric, said method comprising the steps of:

rotating a driving element about a shaft coupled to said loom, imparting the rotation of said driving element through a mechanical linkage comprising first and second spaced apart longitudinal elements to a crank arm which imparts reciprocating motion to a lay beam on which said reed is mounted;

controlling the pressurization of a pneumatic cylinder so that there is a first spacing between said longitudinal elements during said third pick of each of said three pick cycles and a second spacing between said longitudinal elements during the first two picks of each of said three pick cycles thereby adjusting the terminal point of said reed during reciprocation so as to enable full beat-up of said third pick and partial beat-up of said first two picks.

5. In a loom for weaving pile-type fabric, an improved reed control mechanism for enabling a reed mounted on a lay beam to perform a multi-pick cycle involving partial beat-up of at least a first pick of weft and full beat up of at least a second pick of weft, said reed control mechanism comprising:

means for imparting reciprocating movement to said lay beam and said reed;

a driving means coupled to said loom; and a mechanical linkage connecting said driving means to said reciprocating movement imparting means for enabling said driving means to drive said reciprocating movement imparting means, the improvement being characterized in that said mechanical linkage comprises first and second spaced apart elements and a pressure operated control element for maintaining a first spacing between said elements during said first pick of weft and a second spacing between said elements during said second pick of weft, thereby adjusting the terminal point of said reed during reciprocation to enable said partial beat-up of at least said first pick and said full beat up of at least said second pick, wherein said pressure operated element is a hydraulic piston-cylinder whose piston-rod is fastened to one of said elements and whose base is fastened to the other of said elements.

6. The reed control mechanism of claim 5, wherein said piston-rod includes an adjustable element for making an adjustment in the length of the mechanical linkage during said partial beat-up of said first pick and thus an adjustment in the pile height of said pile-type fabric.

7. In a loom for weaving terry type fabric, a reed control mechanism for enabling the reed to perform a three pick cycle comprising partial beat up of the first two picks followed in succession by a full beat-up of the third pick, said reed control mechanism comprising:

a lay beam on which said reed is mounted;

means for imparting reciprocating motion to said lay beam and said reed;

driving means coupled to said loom;

a mechanical linkage connecting said driving means to said reciprocating motion imparting means to enable said reciprocating motion imparting means to reciprocate said lay beam, said mechanical linkage comprising first and second spaced apart longitudinal elements and a pneumatic cylinder located between said spaced apart longitudinal elements; and means for controlling the pressurization of said cylinder so that there is a first spacing between said longitudinal elements during said third pick of each of said three pick cycles and a second spacing between said longitudinal elements during the first two picks of each of said three pick cycles thereby adjusting the terminal point of said reed during reciprocation so as to enable full beat-up of said third pick and partial beat up of said first two picks.

8. A method for enabling a reed in a terry loom to operate on a three pick cycle, said cycle comprising partial beat-up of the first two picks and full beat-up of the third pick to form a terry type fabric, said method comprising the steps of:

rotating a driving element about a shaft coupled to said loom;

imparting the rotation of said driving element through a mechanical linkage comprising first and second spaced apart longitudinal elements to a crank arm which imparts reciprocating motion to a lay beam on which said reed is mounted; and controlling the pressurization of a hydraulic cylinder so that there is a first spacing between said longitudinal elements during said third pick of each of said three pick cycles and a second spacing between said longitudinal elements during the first two picks of each of said three pick cycles thereby adjusting the terminal point of said reed during reciprocation so as to enable full beat-up of said third pick and partial beat-up of said first two picks.

* * * * *